United States Patent [19]

Speitel et al.

[11] 4,367,965

[45] Jan. 11, 1983

[54] CASING FOR LIPSTICK OR BALL POINT PEN REFILLS

[75] Inventors: Francois X. Speitel, Chateau des Landes; Robert F. M. Speitel, Challes-Parigne l'Eveque, both of France

[73] Assignee: Teleplastics Industries Company, Parigne l'Eveque, France

[21] Appl. No.: 221,012

[22] Filed: Dec. 29, 1980

[30] Foreign Application Priority Data

Dec. 27, 1979 [FR] France ..... 79 31727
Sep. 15, 1980 [FR] France ..... 80 19813

[51] Int. Cl.[3] ..... A45D 40/06
[52] U.S. Cl. ..... 401/60; 401/107; 401/108
[58] Field of Search ..... 401/99, 107, 108, 117, 401/59, 60

[56] References Cited

U.S. PATENT DOCUMENTS

| | | | |
|---|---|---|---|
| 1,776,098 | 9/1930 | Barbas | 401/60 |
| 2,402,072 | 6/1946 | Nehrke | 401/60 |
| 2,453,250 | 11/1948 | Nehrke | 401/60 |
| 3,810,700 | 5/1974 | Bryan | 401/59 |
| 3,941,489 | 3/1976 | Bryan | 401/59 |

FOREIGN PATENT DOCUMENTS

| | | | |
|---|---|---|---|
| 721239 | 3/1932 | France | 401/60 |

*Primary Examiner*—Edward M. Coven
*Attorney, Agent, or Firm*—Cushman, Darby & Cushman

[57] ABSTRACT

A container for rigid products such as small, ball-pen refills and the like comprising a body and an opening, a flexible element sliding in guide means by means of a push button, and a cover for holding the contents thereof. The casing is characterized in that the push button is mounted elastically relative to the body. According to a modification this elasticity is attained by attaching the push button to one end of the flexible element, with said end being made thinner so as to be capable of extending toward the outside of a slot.

4 Claims, 10 Drawing Figures

Fig. 1
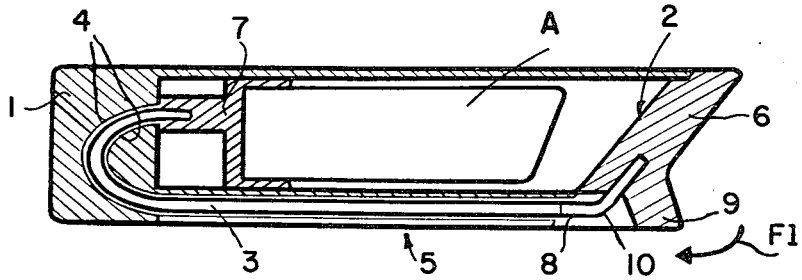
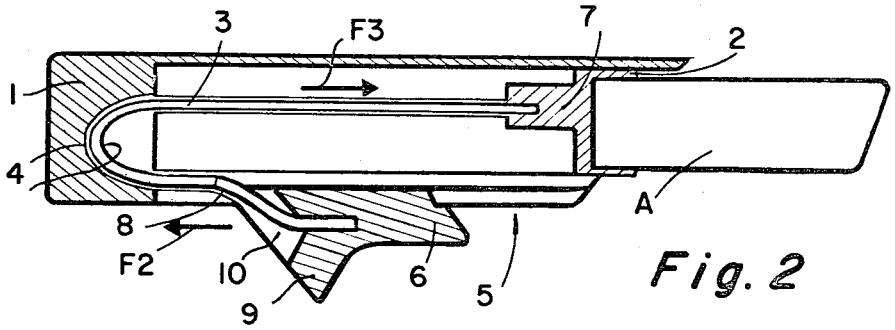
Fig. 2
Fig. 3
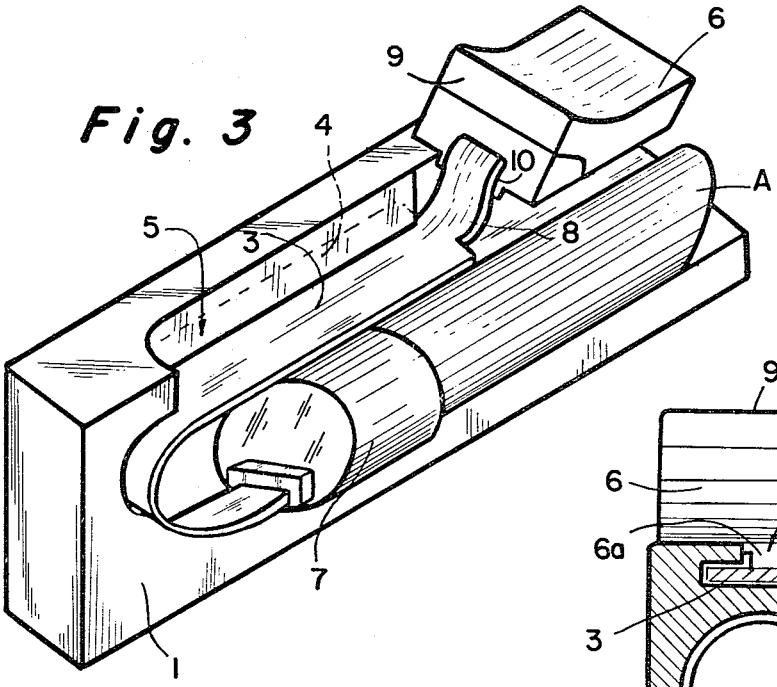
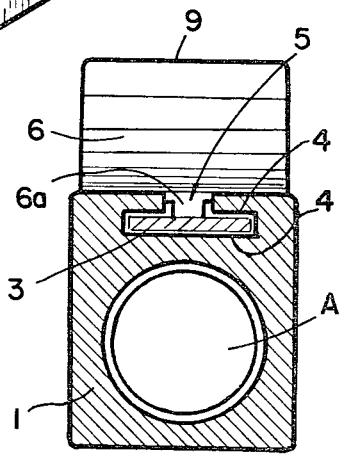
Fig. 4

CASING FOR LIPSTICK OR BALL POINT PEN REFILLS

The present invention relates to a container or casing for rigid products and, more particularly, to a lipstick casing.

Containers for lipsticks, ball point pens, glue sticks and the like are known and comprise a body with an opening and a flexible element actuated by means of a push button to cause the extraction of the contents through the opening.

Particular reference is made to French Pat. No. 721,239 which describes a lipstick container 12 comprising a push button 7 connected to a flexible element 3 by means of a rigid flange 9 arranged in a slot 6 and held in that position by means of a rigid pin 14 which is integral with the flexible element 3.

This device differs from the present invention which provides that the push button is connected to the end of the flexible element by means of an elastic mounting of the push button.

French Pat. No. 933,926 describes a lipstick casing whose support is connected to a flexible element, but the latter does not extend beyond the upper opening which can only be covered by a cover 3, pivoted to the flexible end.

The present invention on the contrary expressly provides for the use of the flexible element at right angles to the upper opening, at least in part, when the push button is in the closed position, as well as the rigid non-pivoting of the push button relative to the flexible portion so that the push button is elastically applied when it blocks the opening.

U.S. Pat. No. 2,453,250 is similar to the two patents cited above in that the cover—push button 21 is pivoted at the end of the flexible element 18 which cannot be located, even partly, at right angles to the upper opening since the latter lies in a plane perpendicular to the axis of the casing and not in an inclined plane.

French Pat. No. 663,721 is almost identical to the foregoing patent as the cover which forms the push button is pivoted on a pin 3 by a hinge 5, and the pin 3 is provided at the end of the flexible element 15, with the opening being perpendicular rather than inclined with respect to the general axis of the casing.

The same is true for U.S. Pat. No. 1,776,098.

The present invention differs radically from these prior art devices in that it provides flexible means of the push button relative to the internal guide means which extend, at least in part, at right angles to the upper opening.

The invention is explained in the following detailed description in which reference is made to the attached drawings. The description and the drawings give only examples and do not limit the invention.

FIGS. 1 and 2 are sectional views of a lipstick casing according to a first embodiment and represent, respectively, the closed position and the open position.

FIG. 3 is a partial schematic view of the same casing in perspective.

FIG. 4 is a sectional view of another embodiment of the present invention.

Figure 5:
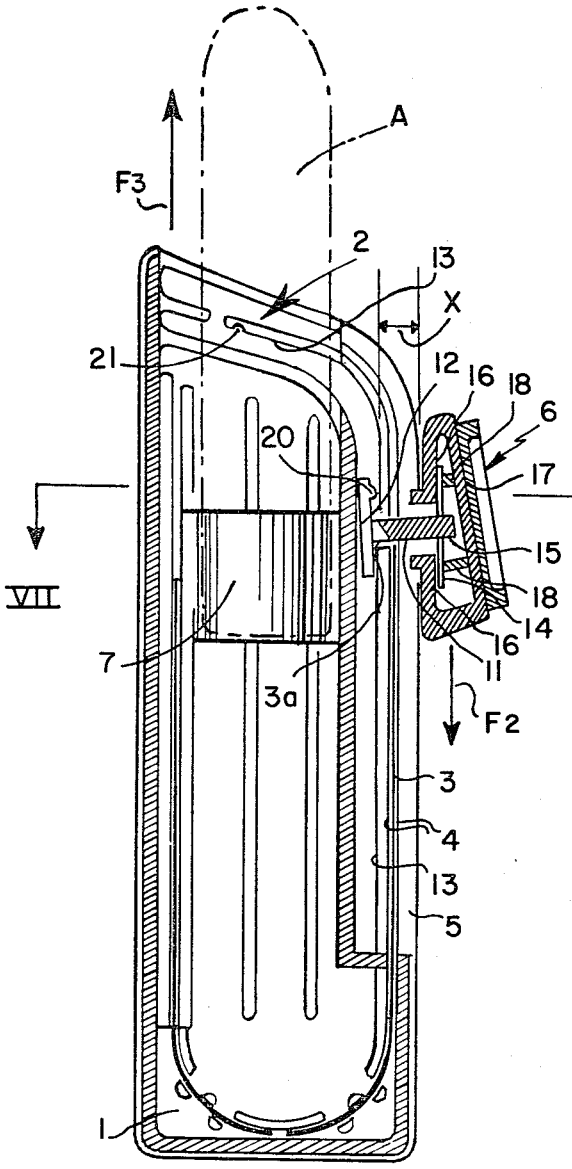
FIGS. 5 and 6 illustrate an axial section of another embodiment of the casing with two different positions of the push button.

A casing or container in accordance with the present invention is of the type comprising a body 1 with an opening 2 for the passage of the contents (A) and a flexible element 3 which slides in the internal guide means 4 of the body 1 at right angles to a slot 5, attached at one of its ends to an extraction means 7 of the contents A and connected at its other end to an actuating push button 6, which can be placed either opposite the slot 5 so as to leave the opening 2 free, or opposite said opening 2 so as to cover it in the manner of a lid, and is characterized in that the push button—cover 6 is elastically mounted with respect to the guide means 4 of the body 1.

In the embodiments shown in FIGS. 1 to 3, the push button—cover 6 is mounted flexibly by means of its connection to a piece 8, constituted by a section of the flexible element 3, itself elastic.

According to one variant, the piece 8 which connects the push button—cover 6 to the flexible element 3, consists of a narrow part of the element 3 so that it can extend outside of the slot 5 between the edges thereof.

Under these arrangements, the flexible element 3, which consists here of a thin flexible plate may be quite narrow so as to give a slight separation to the guide means 4, has, under any circumstances, smaller dimensions than the inner dimensions of the body 1.

Simultaneously, while the flexible element 3 may be narrow, the cover, consisting of the push button 6, can be as wide as desired, if only for esthetic reasons, as a result of the fact that this push button—cover 6 moves on the outside of the slot 5 and is also positioned on the outside of the opening 2.

In order to facilitate actuation of the push button—cover 6, it has a protrusion 9 located near its end adjacent to the flexible element 3 so that by pushing on said protrusion 9, one induces first the pivoting of the push button—cover 6, and then its sliding the length of the slot 5.

To secure a perfect fit of the push button—cover 6 over the opening 2 and to make sure that no accidental movement can cause the push button—cover 6 to open, it is advisable to attach it to the flexible element 3 by means of a piece 8 formed by the narrowed end of the flexible element 3, which accordingly forms a narrow tongue capable of passing between the longitudinal edges of the slot 5, said narrow tongue being cambered at an angle 10.

Since the flexible element 3 is elastic, the camber at an angle 10 brings about the brisk folding back of the push button—cover 6 as soon as it is free from the sides of the body 1, very much like the cover of a cigarette lighter, for example.

To extract a lipstick A, the push button—cover 6 is actuated by pressing on its protrusion 9 in the direction of arrow F1, following which the sliding movement is continued along the length of the body 1, along arrow F2, which has the correlative effect of moving the socket 7 in the direction of arrow F3.

Prior to an operation of the push button—cover 6 and uncovering the opening 2, the outer end of the lipstick A can never touch the cover, even if it is longer than normal, since such length is compatible with the proper closure of the casing.

The body 1 can preferably be made by uniting two corresponding parts (or "shells", only one of which is visible in FIG. 3). The two parts are made by singlepiece molding from a synthetic material.

The two shells are united after introducing the flexible element 3 between the guide means 4 and the socket or tubular casing 7 in the center of the body 1.

The flexible element 3 can be made integral with (a) one portion of the push button—cover 6 and (b) with the socket 7 by molding those elements from a casting as shown.

The push button—cover 6 is kept in place opposite the opening 2 by any known type of pawl and ratchet mechanism.

In another embodiment of the present invention the piece 8, by means of which the push button—cover 6 is connected to the flexible element 3, is formed by a slide 6*a* which is integral with the push button—cover 6, as shown in FIG. 4.

Figure 6:
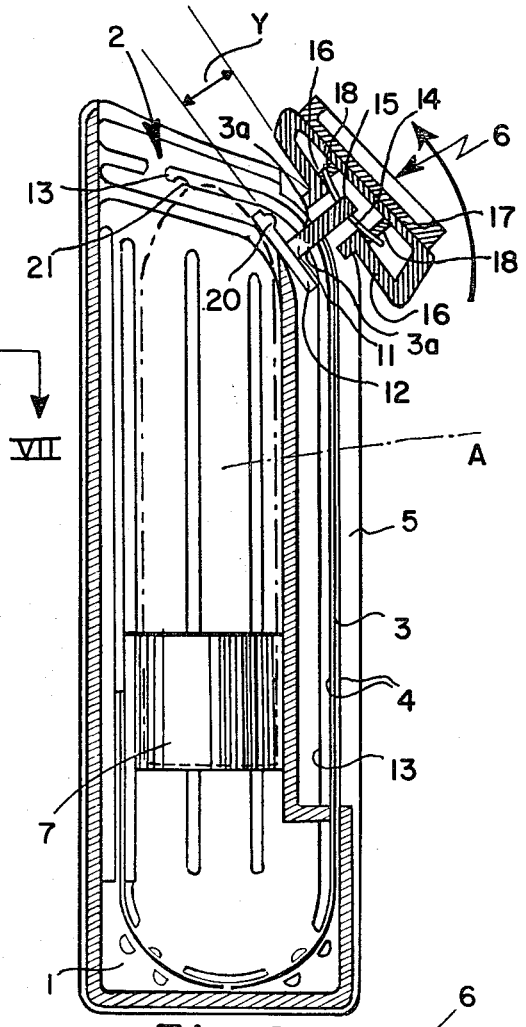
Figure 7:
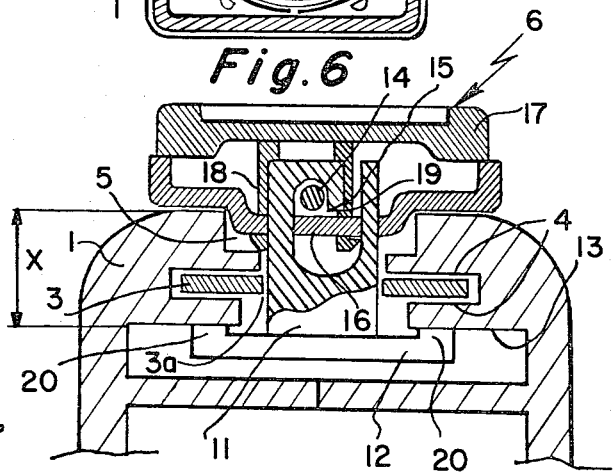
FIG. 7 is a schematic view on a larger scale showing the assembly of push button, the slide and the flexible element.

FIGS. 5 to 7 illustrate another embodiment of the improved casing of the present invention.

The casing shown in FIGS. 5 to 7 is characterized in that the flexible element 3 has a uniform size, even with respect to that portion which is closest to the push button 6, and in that said portion is freely traversed by a lug 11 flexibly connected to the push button 6, near the central portion of the latter.

According to a feature of the present invention, the slide block 12 is located opposite a rib 13 parallel to the guide means 4 of the flexible element 3 and is forced against said rib 13 by elastic means such as a piano wire 14 which traverses a passage 15 of the lug 11 and is supported on two edges 16 of the push button 6 substantially parallel to the plane of the flexible element 3, so that the lug 11 and the push button 6 can be elastically separated from one another or elastically urged together.

Referring now to FIG. 5, it can be seen that the push button 6 is in the rectilinear part of its trajectory, i.e., within the curve connecting that rectilinear part and the closure plane of the opening 2.

Behind the innermost guide means 4 a space has been provided which forms the rib 13. Against this rib, the slide block 12 is elastically engaged in such a way that the piano wire 14 is supported by both edges 16 of the push button 6 and that the latter is supported by the body 1 on both sides of the slot 5.

The dimensions are chosen in such a way that the slide block 12 is pressed elastically against the rib 13 without excessive friction.

The lug 11 traverses the flexible element 3 through a hole 3*a* whose dimensions are such that the lug 11 can extend through the flexible element 3 relatively free, but of course the lug 11 is supported on one or the other of the transverse edges of the hole 3*a* depending on the direction in which the push button 6 is activated.

In the position shown in FIG. 5, the piano wire 14 has relatively weak action and the distance X between the surface or face of the push button 6 which presses against the body 1 and the surface or face of the slide block 12 which engages the rib 13 is at a minimum.

When the lipstick A is to be moved back into the casing, the push button 6 is activated in the direction opposite that of arrow F2. In order to bring the push button 6 into its closing position on the upper opening 2, it is necessary that the movable unit attached to the flexible element 3, i.e. push button 6—slide block 12, passes beyond the curved portion to move on to the rectilinear portion inclined at a right angle to the opening 2 (upper part of the casing, FIG. 6).

In the position shown in FIG. 6, it can be seen that such movement is only possible when the push button 6 and the slide block 12 are separated from each other, failing which the moving unit would be jammed.

In the first embodiment of the present invention a smooth movement is attained due to the fact that a portion of the flexible element 3 extends from the inside toward the outside to the external push button 6 and forms an intermediate elastic element.

This result is attained due to the transverse elasticity of the piano wire 14 (FIG. 6).

The slide block 12 must have a certain length located along the wire corresponding to the circular arc of the rib 13 in its curved portion. Therefore, the lug 11 must enter the interior of the casing while the push button 6 rests against the body 1, and this for a length equal to the arrow corresponding to the wire and to the circular arc mentioned above, which yields a separation Y between the face or surface of the push button 6 pressed against the body 1 and the face or surface of the slide block 12 pushed against the rib 13, the said distance Y being greater than the distance X.

This elastic deformation of the unit is possible since the piano wire 14 at its ends rests against the two edges 16 of the push button 6 (FIG. 6).

When the push button 6 reaches beyond the curved zone, at right angles to the opening 2, the piano wire 14 elastically reins in the lug 11 and the slide block 12 so that the entire arrangement resumes the position it has in FIG. 5, but this time at a right angle to the upper opening 2.

Here, the push button 6 is characterized in that it has an outer face which is hollowed out so that it forms a seat for the lug 11 and the piano wire 14, a cover 17 being placed over them and held in place by any known means for hiding said units 11–14, and to provide an actuating surface for the operation of the push button 6 as a unit.

According to one preferred embodiment (FIG. 7) the means to keep the cover 17 in place are formed by hooks 18 and 19 placed on either side of the piano wire 14 to assure that the latter is properly held in place.

Here, the hooks 18 and 19 are substantially in the shape of spear tips and can be elastically deformed because they are formed integral with the cover 17 out of a plastic material. They protrude into the space which separates the two edges 16 in such a way that, after having assumed their original position, their spear-shaped ends are located beneath the adjacent sides of the edges 16.

The piano wire 14 has a certain length, unlike the upper portion of the lug 11 which is relatively thin. It can happen that the piano wire moves obliquely and ultimately leaves the position it should be in. By arranging the hooks 18 and 19 on both sides of the piano wire and positioning them relatively far apart longitudinally (FIGS. 5 and 6), it is possible to ensure that the piano wire 14 cannot pivot and leave its proper position.

As can be seen, the above ensures an elastic mounting of the push button 6 relative to the body 1, as well as a positive guiding of the relative movements of the push button 6 and the flexible element 3.

Moreover, as the push button 6 is guided positively until it reaches its extreme position covering the opening 2, it is easily handled and maintained in place.

As its sliding has been made easy and flexible by the elasticity provided by the mounting described above, the push button 6 can slide accidentally and slightly uncover the opening 2. The resulting opening could allow dust or foreign objects to enter and soil the inside of the casing. Beyond the fact that this could impair the sliding of the unit along the guide means 4–13, the lipstick itself would become soiled.

According to a modification of the present invention, these drawbacks are prevented by providing that the movable element attached to the flexible element 3, i.e. the push button 6—slide block 12, is provided with means for cooperating with a member integral with the body 1 to immobilize elastically said movable element in a position closing off the opening 2.

These means can consist of a tongue and an element integral with the body 1 in a location positioned at the end of the path of movement of the push button 6.

But according to a preferred embodiment, the means provided on the movable unit are formed by lateral protrusions 20 for cooperation with notches 21 positioned at the side of the opening 2.

The protrusions 20 have a rounded profile, as do the notches 21, so that they can be joined and separated with ease. The entry of the protrusions 20 into the notches 21 produces a genuine ratchet effect due to the fact that the piano wire 14 constantly urges the slide block 12 against the rib 13 and hence in the direction of the notches 21 provided in said rib 13. Removal of the protrusions 20 from the notches 21 thus operates in reverse manner by actuating the piano wire 14.

It can be seen that the importance of this modification lies in allowing the elastic means to participate in the operation of the racheting effect.

The push button 6 is thus pushed vigorously so that the closing of the opening 2 at the upper part of the body 1 is secured. The push button keeps the dust out and is also firmly pressed against the edges of the opening 2.

Figure 8:
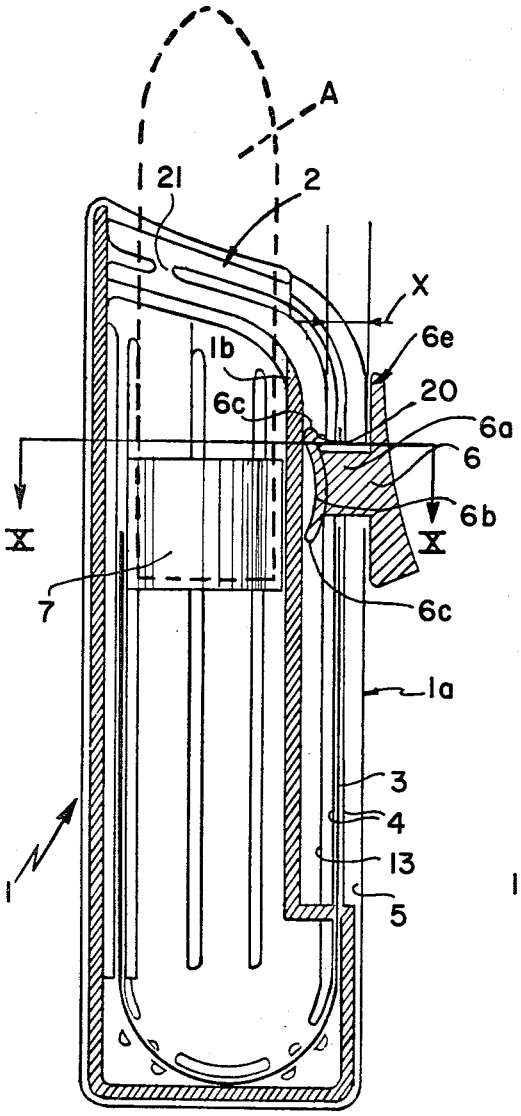
FIGS. 8 and 9 represent a casing in axial section, which illustrates still another embodiment of the present invention.
Figure 9:
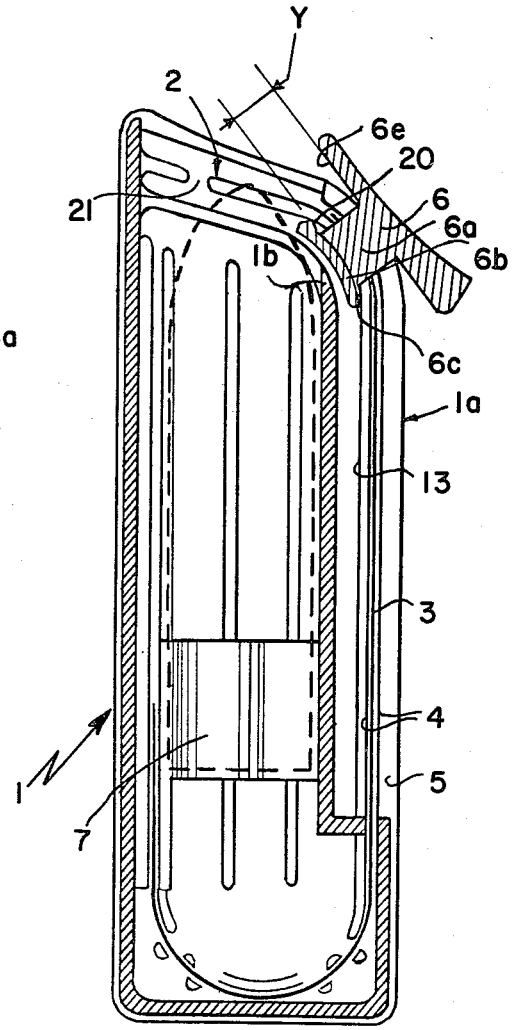
Figure 10:
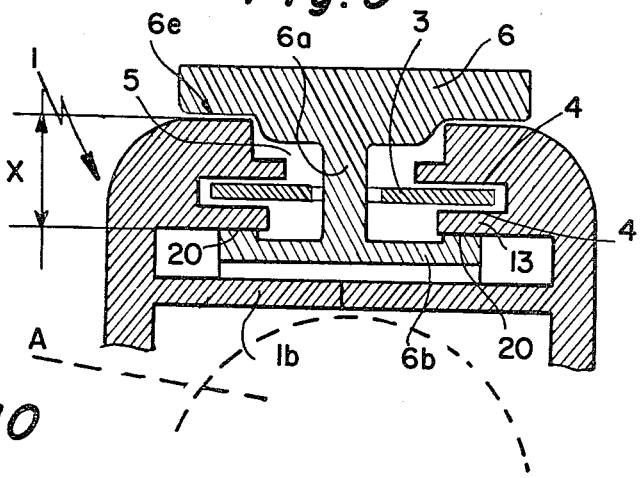
FIG. 10 is a partial sectional view along the line X—X of FIG. 8.

Referring now to FIGS. 8, 9 and 10, it can be seen that according to another embodiment of the invention, a casing is characterized in that the push button—cover 6 is mounted elastically by virtue of its being formed of an elastic material, at least with respect to its lug **6*a* and its slide block 6*b* which is integral with the lug 6*a* and is urged against a rib 13, said slide block 6*b* preferably being arched so that it has a convexity oriented toward the lug 6*a*, in accordance with a curvature such that the distance x which extends from the points of support of the slide block 6*c* against the rib 13 to the push button—cover 6 is more or less equal to the distance separating the rib 13 from the outer face 1*a* of the body 1 on which the push button—cover 6** must be supported.

This results in the same operation as described above, as the entire elastic arrangement plays the role of the piano wire 14.

According to one feature of the invention, the slide block **6*b* has edges 6*c* which are substantially transverse to the axis of the rib 13** and are rounded off.

This ensures that during successive displacements of the slide block **6*b* there will be no wear, erosion or jamming with the crosspiece 1*b***.

According to another feature of the invention, the lateral protrusions 20, designed to cooperate or interface with notches 21 located on the sides of the opening 2, are positioned near one of the rounded edges **6*c*, on the convex surface of the slide block 6*b***.

This results in the same advantages as those described above, i.e. the push button—cover 6 is elastically maintained in place when it is at right angles to the opening 2.

The fact that the push button—cover 6, the lug **6*a* and the slide block 6*b* are all obtained by molding in one piece, also makes it possible to make the flexible element 3 of one single piece and possibly the means 7** for extracting contents A as well.

The entire container can thus be made in three pieces: two half shells forming, after gluing, the body 1 and a single piece comprising the flexible element 3, the extraction means 7 and the push button—cover 6.

In accordance with the invention the internal guide means 4 as well as the outer surface **1*a* of the body 1, on which the push button—cover 6 is to engage by means of its inner face 6*e*, have a curved profile which makes their rectilinear outlines flush at right angles to the opening 2 and at right angles to the slot 5, while the curvature of the slide block 6*b* has a radius between that of the rib 13, on the one hand, and an internal crosspiece 1*b* of the body 1, on the other hand, both of these being present in the curved outline area as the slide block 6*b* extends from the rib 13 to the crosspiece 1*b***.

FIG. 9 shows that the slide block **6*b* moves without any possibility of jamming of the elbow part formed by the curved profile of the rib 13 and the crosspiece 1*b*, which follow the curved profile of the internal guide means 4 and the outer face 1*a* of the body 1**.

The material selected for molding should be sufficiently flexible, but must have enough "character" so as not to lose, over a period of time, its capacity for permanent resilient reaction.

The invention is not limited to the embodiments described but encompasses all other variations.

We claim:

1. A container comprising an elongated body with an opening in the terminal face for the passage of the contents therein, a slot along a longitudinal lateral side of said body, said slot ending in said opening through a rounded part and merging in the internal chamber of said body, guide means forming grooves in the lateral sides of said slot, a flexible element sliding in said guide means forming grooves and attached at its one end within said internal chamber to the contents which is slidingly guided in said chamber and at its other end to an actuation push button which can slide outside of the body along said slot and over said opening so as to cover said opening, second guide means forming grooves in the lateral sides near the bottom of said slot ending in grooves on the lateral sides of the opening parallel to said slot through a rounded part, a sliding block slidingly mounted in said second guide means forming grooves, fastening means joining said sliding block and said push button and means biasing said push button toward said sliding block.

2. The container of claim 1 in which said fastening means joining said sliding block and said push button, and said means biasing said push button toward said sliding block comprise a lug fast with said sliding block and going through said slot and elastic means connecting said lug to the push button near the central portion thereof.

3. The container of claim 2 in which said elastic means connecting said lug to the push button comprises a piano wire traversing a passage in the lug and engaging two edges of the push button substantially parallel to the slot.

4. The container of claim 1 in which said fastening means joining said sliding block and said push button and said means biasing said push button toward said sliding block comprise said sliding block made of a flexible material, elongated along the longitudinal direction of the slot and arched with its convexity oriented toward the push button and a lug merging from the central part of said sliding block toward the push button and fastened to said push button.

* * * * *